US012371081B2

(12) United States Patent
Jovenall et al.

(10) Patent No.: US 12,371,081 B2
(45) Date of Patent: Jul. 29, 2025

(54) VISION-BASED SYSTEMS AND METHODS FOR LOCOMOTIVE CONTROL AND/OR LOCATION DETERMINATION

(71) Applicant: Cattron North America, Inc., Warren, OH (US)

(72) Inventors: Jeremy Jovenall, Mercer, PA (US); Brian Fette, Canfield, OH (US); Larry Foore, Bayfield, OH (US)

(73) Assignee: Cattron North America, Inc., Warren, OH (US)

( * ) Notice: Subject to any disclaimer, the term of this patent is extended or adjusted under 35 U.S.C. 154(b) by 582 days.

(21) Appl. No.: 17/897,962

(22) Filed: Aug. 29, 2022

(65) Prior Publication Data

US 2023/0087606 A1 Mar. 23, 2023

Related U.S. Application Data

(60) Provisional application No. 63/247,432, filed on Sep. 23, 2021.

(51) Int. Cl.
*B61L 25/02* (2006.01)

(52) U.S. Cl.
CPC ..... *B61L 25/025* (2013.01); *B61L 25/026* (2013.01); *B61L 2205/04* (2013.01)

(58) Field of Classification Search
CPC ... B61L 25/025; B61L 25/026; B61L 2205/04
See application file for complete search history.

(56) References Cited

U.S. PATENT DOCUMENTS 5,021,715 A 6/1991 Smith et al.
7,379,572 B2 5/2008 Yoshida et al.
(Continued)

FOREIGN PATENT DOCUMENTS

CN 109747681 A * 5/2019
DE 102007021580 A1 11/2008
(Continued)

OTHER PUBLICATIONS

Design World Staff, "Remote Control Locomotive Equipment Helping to Ensure More Accurate, Safer Pullback Operations". (Year: 2011).*
Oh, S, KR 20130108715, machine translation. (Year: 2013).*
Xia, M, CN 109747681, machine translation. (Year: 2019).*
Extended European Search Report for EP22195834 that claims priority to the instant application; 10 pages; dated Feb. 7, 2023.
PCT International Search Report and Written Opinion for PCT/US2022/041888 filed Aug. 29, 2022 that claims priority to the same parent application as the instant application; Dec. 13, 2022; 11 pages.
(Continued)

*Primary Examiner* — Mark L. Greene
(74) *Attorney, Agent, or Firm* — Harness, Dickey & Pierce, P.L.C.; Anthony G. Fussner

(57) ABSTRACT

Exemplary embodiments are disclosed of vision-based systems and methods for locomotive control and/or location determination. In exemplary embodiments, a system includes at least one camera positionable onboard a locomotive for capturing one or more images of trackside signage including location data corresponding with location (s) along a track. The system also includes at least one processor configured for communication with the at least one camera for receiving the one or more images of the trackside signage captured by the at least one camera. The at least one processor is configured to analyze the one or more images and visually recognize the location data of the trackside signage in the one or more images captured by the at least one camera, thereby enabling the system to identify the locomotive's location along the track via the at least one processor's visual recognition of the location data of the trackside signage.

31 Claims, 8 Drawing Sheets

(56) References Cited

U.S. PATENT DOCUMENTS

| | | | |
|---|---|---|---|
| 8,170,372 | B2 | 5/2012 | Kennedy et al. |
| 8,971,581 | B2 | 3/2015 | Wu et al. |
| 10,186,147 | B2 | 1/2019 | Imai |
| 2011/0285842 | A1 | 11/2011 | Davenport et al. |
| 2019/0095725 | A1 | 3/2019 | Kalghatgi et al. |
| 2019/0156475 | A1 | 5/2019 | Markson et al. |
| 2021/0061324 | A1 | 3/2021 | Jovenall |

FOREIGN PATENT DOCUMENTS

| | | | | |
|---|---|---|---|---|
| DE | 102019206347 | A1 | | 11/2020 |
| KR | 20130108715 | A | * | 10/2013 |
| WO | WO-2006106789 | A1 | | 10/2006 |
| WO | WO-2007091072 | A1 | | 8/2007 |

OTHER PUBLICATIONS

Pullback Stopping Protection (PSP); Cattron.com; Aug. 2021; 8 pages.

Introducing LCS-III—the latest generation locomotive control system by Cattron for FRA Regulated rail operations in the Americas; Cattron.com; Mar. 17, 2021; 2 pages.

LCS-III; Locomotive Control System; Comprehensive Safety Solution for FRA Regulated Railroad Operations; Cattron.com; Mar. 17, 2021; 2 pages.

* cited by examiner

| Full String | Unique ID | Prefix Indicator | Suffix Indicator | Meaning |
|---|---|---|---|---|
| 0 74902 1 | 74902 | 0 | 1 | Unique ID applicable if read and image exits left of frame, meaning that the track is to the right of the vision post. |
| 1 74902 0 | 74902 | 1 | 0 | Unique ID applicable if read and image exits right of frame, meaning that the track is to the left of the vision post. |
| 1 74902 1 | 74902 | 1 | 1 | Unique ID is applicable if read and exits either side of frame, meaning that there are parallel PSP tracks. |
| 0 74902 0 | 74902 | 0 | 0 | Invalid |

FIG. 4

VISION-BASED SYSTEMS AND METHODS FOR LOCOMOTIVE CONTROL AND/OR LOCATION DETERMINATION

CROSS-REFERENCE TO RELATED APPLICATION

This application claims priority to and the benefit of U.S. Provisional Patent Application No. 63/247,432 filed Sep. 23, 2021. The entire disclosure of this provisional patent application is incorporated herein by reference.

FIELD

The present disclosure generally relates to vision-based systems and methods for locomotive control and/or location determination.

BACKGROUND

This section provides background information related to the present disclosure which is not necessarily prior art.

There are currently several methods of controlling locomotive movements through automation that utilize RFID technology. More specifically, RFID track transponders or tags may be installed in the track bed between the rails. The RFID track transponders may be used for identifying the location of a lead locomotive in a yard.

DRAWINGS

The drawings described herein are for illustrative purposes only of selected embodiments and not all possible implementations, and are not intended to limit the scope of the present disclosure.

FIG. 4 includes a table providing an example vision post numbering system that may be used in exemplary embodiments of the present disclosure.

Figure 5:
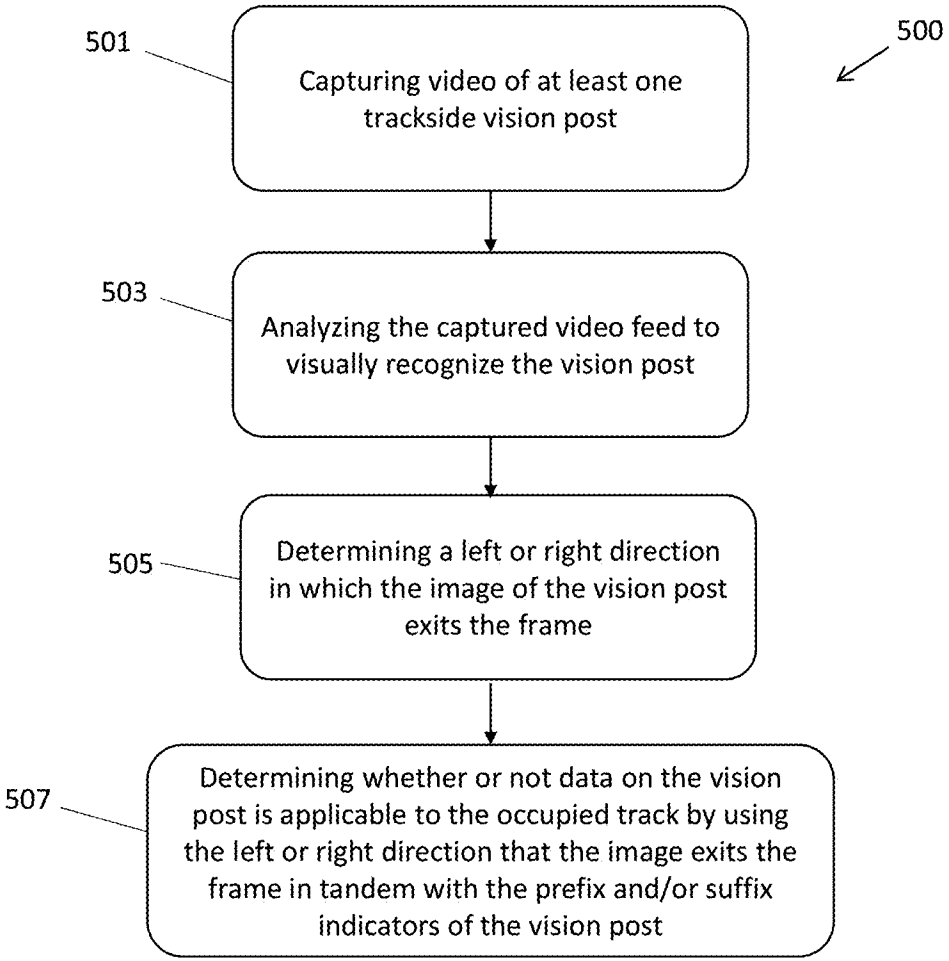

FIG. 5 is a flow chart illustrating an example vision-based method for determining location of a locomotive according to an exemplary embodiment of the present disclosure.

Figure 6:
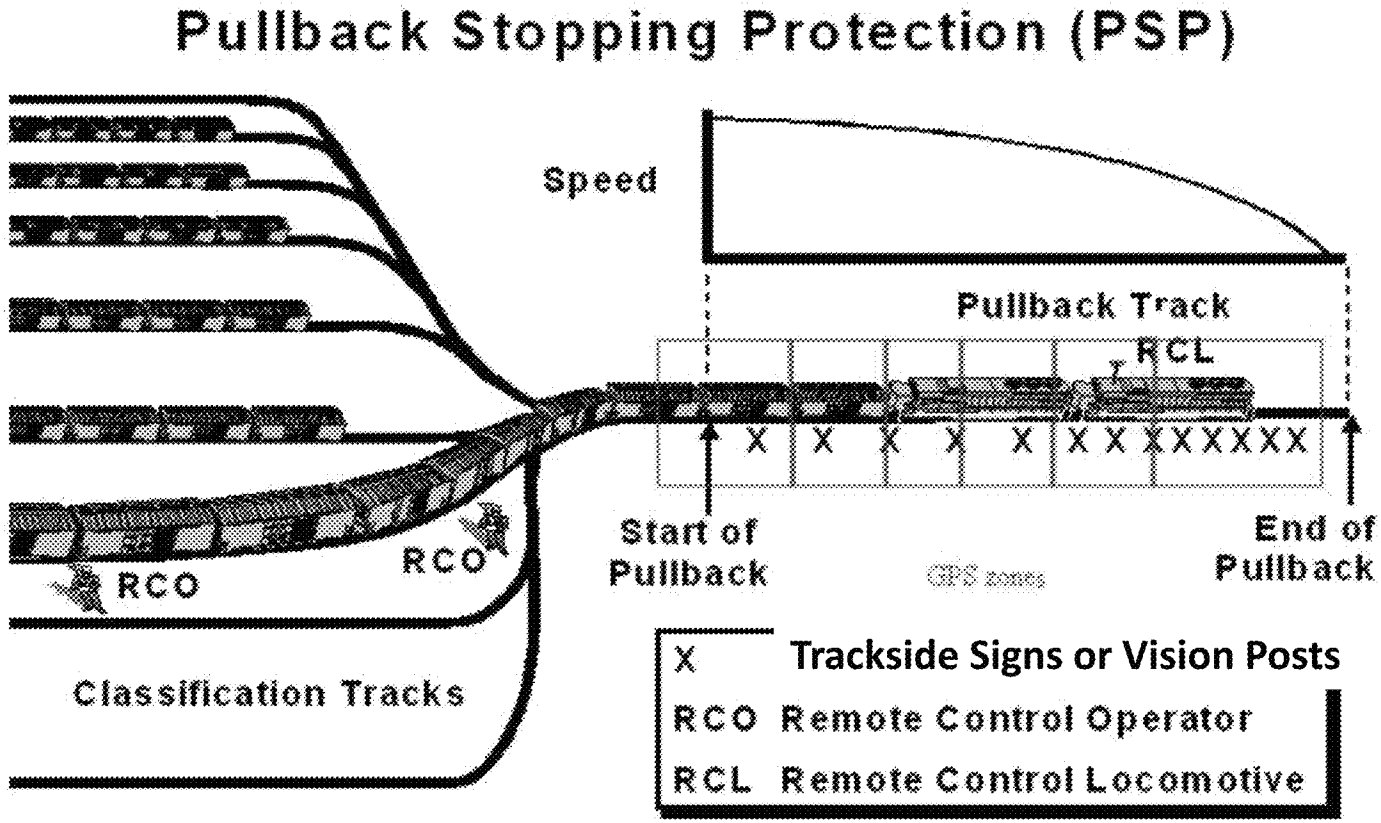

FIG. 6 illustrates an example of pullback stopping protection (PSP) system including RFID transponders, which may be replaced with trackside signs or vision posts according to exemplary embodiments of the vision-based systems and methods disclosed herein.

Figure 7:
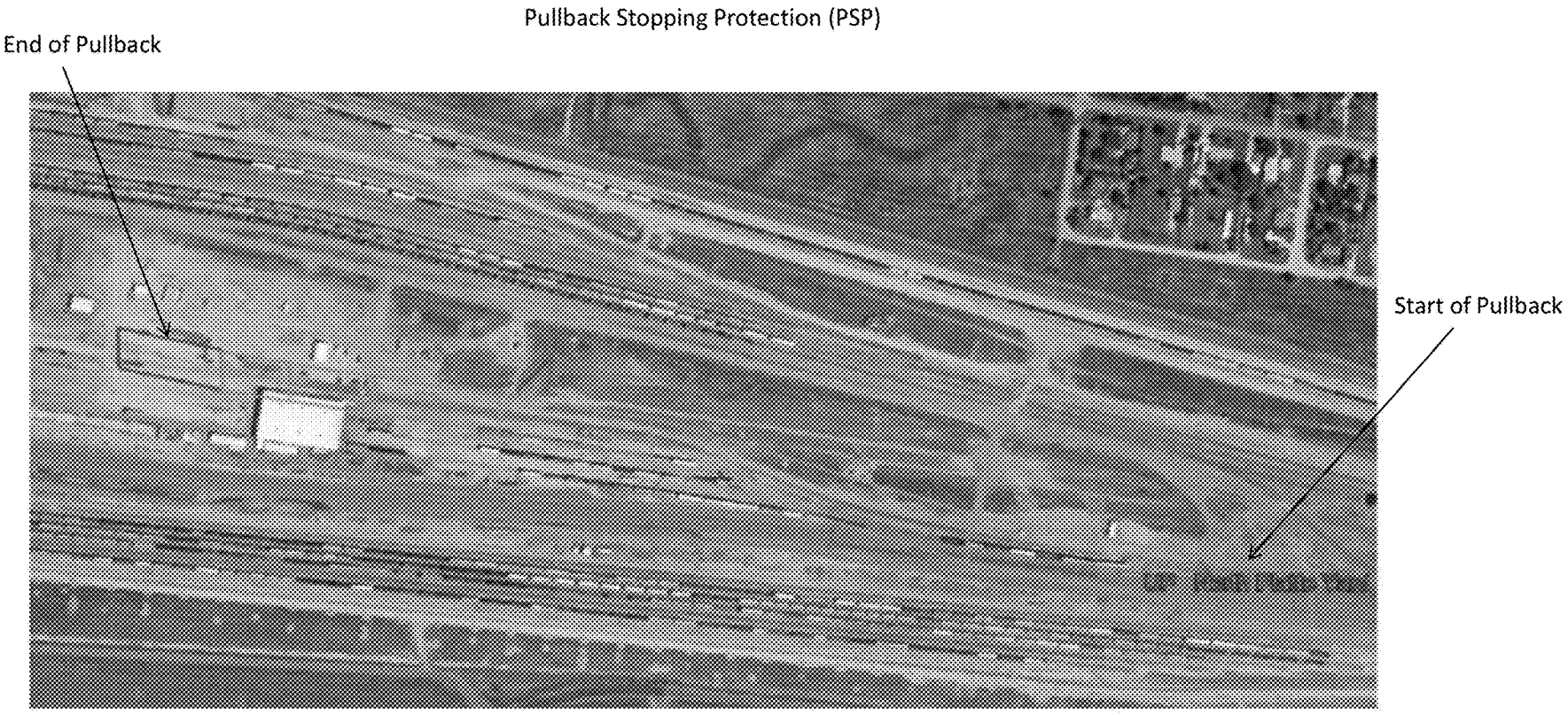
Figure 8:
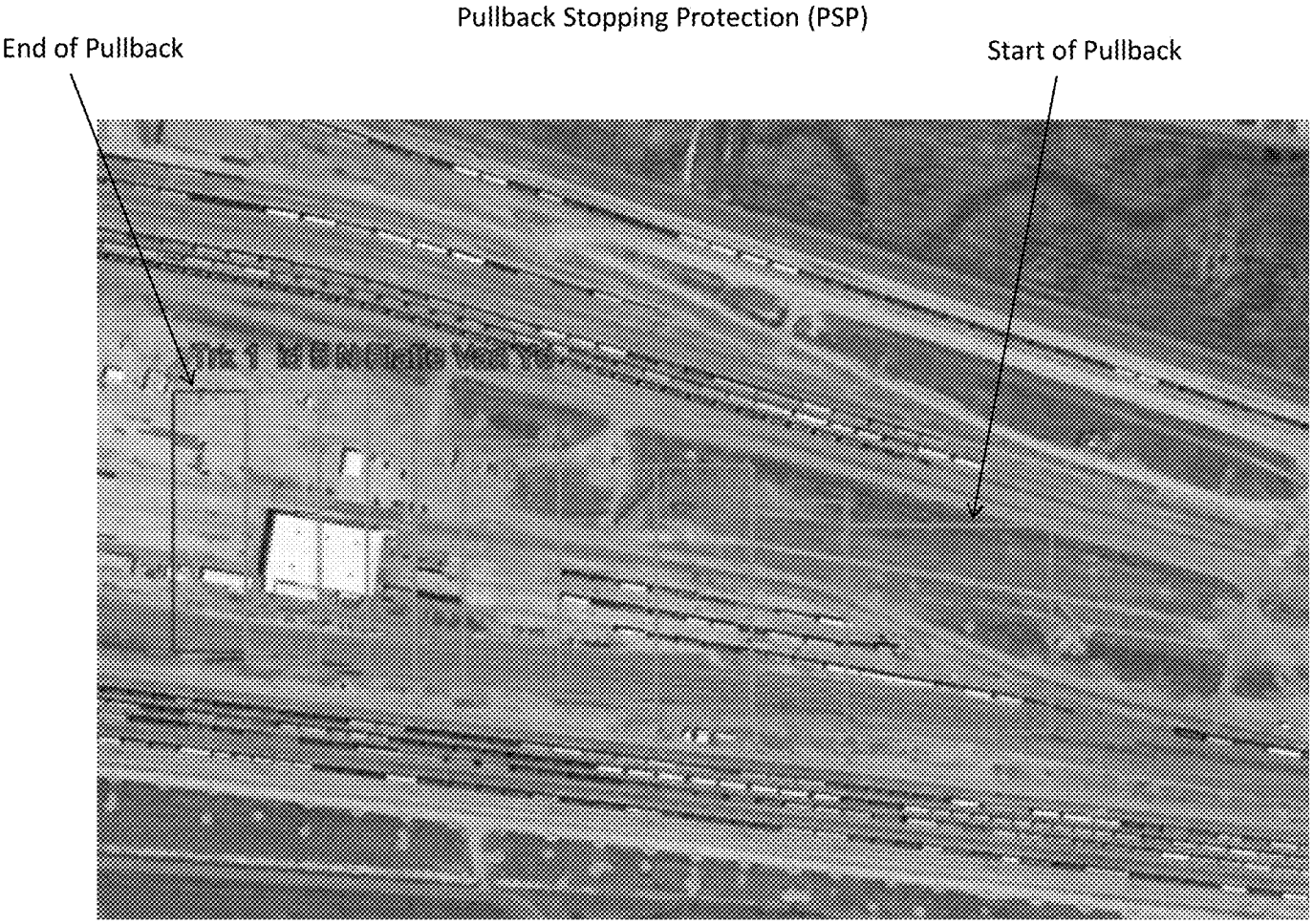

FIGS. 7 and 8 illustrate examples of pullback stopping protection (PSP) zones for the same track.

Corresponding reference numerals may indicate corresponding (though not necessarily identical) parts throughout the several views of the drawings.

DETAILED DESCRIPTION

Example embodiments will now be described more fully with reference to the accompanying drawings.

As noted above, conventional methods of controlling locomotive movements through automation utilize RFID technology. For example, RFID track transponders or tags may be installed in a track bed between the rails. The RFID track transponders may be used for identifying the location of a lead locomotive in a yard.

In addition, a pullback track may be designed through an analysis of track grade and calculation and simulation of train forces for a predetermined maximum tonnage and minimum number of braking axles. The output of the design is a stopping trajectory that is conventionally implemented through the placement of RFID tags or transponders and an overlay of geofences. A remote control locomotive (RCL) system may be configured to enforce a continually descending speed limit to bring the locomotive to a stop before a predetermined point on the track.

As recognized herein, RFID technology may be prone to maintenance and reliability issues, especially in a rail yard or other industrial environment. Although RFID failures are designed to have a safe response, downtime is expensive and reduces productivity.

Disclosed herein are exemplary vision-based systems and methods for identifying the location of a locomotive (broadly, an industrial machine) and/or for controlling locomotive movements (broadly, industrial machine movements) without relying upon RFID transponder data. For example, exemplary methods and systems disclosed herein may be used to identify a location of a locomotive or other industrial machine. The location data may then be used for pullback stopping protection (PSP) functionality or other functionality instead of using RFID transponder data.

Advantageously, the vision-based systems and methods disclosed herein may allow for reduction of downtime, e.g., by eliminating the need for RFID tags and the downtime due to RFID failures that may occur with conventional methods that control industrial machine movements through automation utilizing RFID technology. The vision-based systems and methods disclosed herein may allow for simplification of implementation and increased productivity in freight rail operations or other industrial operations, e.g., as compared to conventional methods utilizing RFID technology.

As an alternative to conventional RFID technology, exemplary methods and systems disclosed herein utilize cameras and artificial intelligence/visual recognition technology for collecting data regarding an industrial machine's location, such as a locomotive's location along pullback tracks, an industrial machine's location within a warehouse or other industrial location, etc. In exemplary embodiments, a front-facing or forward-facing camera onboard an industrial machine is configured to capture video of signage alongside (e.g., trackside signage, signage alongside a route for an industrial machine, etc.) that the industrial machine passes as the industrial machine travels along its determined route. A processor (e.g., a trained visual recognition software program, component, or module, etc.) analyzes the video feed from the front-facing camera to visually recognize or identify signage in the video feed from the front-facing camera.

In exemplary embodiments in which the industrial machine is a locomotive, a front-facing or forward-facing camera onboard the locomotive is configured to capture video of trackside signage that the locomotive passes as the locomotive moves along the track. A processor (e.g., a trained visual recognition software program, component, or module, etc.) analyzes the video feed from the front-facing camera to visually recognize or identify trackside signage in the video feed from the front-facing camera.

In exemplary embodiments, signs or placards (e.g., trackside signage, signage along a route for an industrial machine, etc.) are provided that contain a unique number to which has been associated (e.g., by a locomotive controller, RCL system, an industrial machine controller, etc.) certain attributes required for enforcing a stopping trajectory for a locomotive or other industrial machine. In exemplary embodiments, each unique number has a prefix and suffix that determines which track(s) have the pullback lead associated to the signage active. When the camera system detects signs (e.g., trackside signs, etc.), the camera system also tracks the direction in which a sign leaves or enters the camera's field of vision or field of view (FOV) as the locomotive or other industrial machine passes the sign. The direction that a sign leaves or enters the camera's field of vision is used with the sign's prefix and/or suffix indicator to determine if the sign is applicable, e.g., applicable to the track that the locomotive is using, applicable to the route along which the industrial machine is travelling, etc. The signs or placards may also be referred to herein as vision posts. The vision posts may be similar to mile posts, but the vision posts may be configured to relay more precise location through visual recognition technology as disclosed herein.

Accordingly, the trackside signs or vision posts, front-facing camera, and processor in exemplary embodiments may therefore replace or eliminate the need for the conventional RFID track transponders currently being used for locomotive location in pullback tracks. By eliminating RFID track transponders, exemplary embodiments of the methods and systems disclosed herein may allow for reliability improvements and cost reduction.

In exemplary embodiments, the systems and methods may also or alternatively be configured with additional and/or different functionality. For example, a camera system onboard a locomotive may be used in a system or method for stopping a locomotive to enforce blue signal track signs, monitoring functionality of grade crossing indicators, monitoring for track damage, monitoring for track obstructions, and/or yard automation. As another example, a camera system onboard an industrial machine (e.g., a vehicle, crane, robot, etc.) may be used in a system or method for stopping movement or other operation of the industrial machine within a manufacturing, warehousing, mining, or other industrial site.

In exemplary embodiments, the front-facing camera onboard the locomotive may be further configured to capture video of a railyard when the locomotive is within the railyard and/or as the locomotive moves along a track into or within the railyard. The processor analyzes the video feed from the front-facing camera to visually recognize or identify the lining direction of track switches as part of route verification and/or to prevent the consist from changing direction after passing through a misaligned run-through switch. Some movements under different stages of rail will be treated as a new type of PSP movement wherein knowing the location of the head of train is critical. Accordingly, exemplary embodiments are disclosed herein of systems and methods that use camera systems and visual recognition technology for yard automation, e.g., in real-time from a locomotive, etc.

Figure 1:
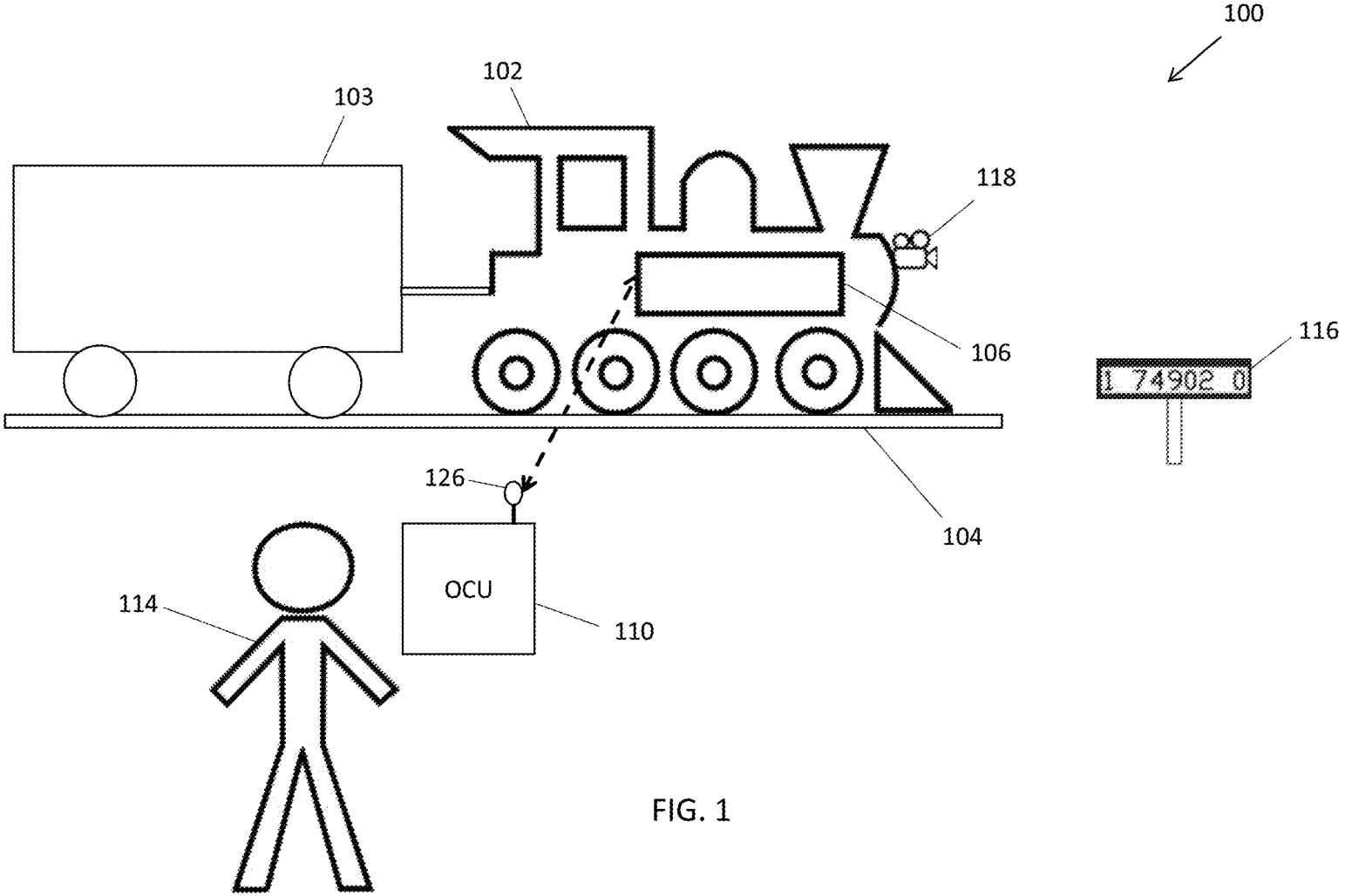
FIG. 1 is a diagram of a vision-based system for locomotive control and/or location determination according to an example embodiment of the present disclosure.

With reference to the figures, FIG. 1 illustrates an automated vison-based system 100 for determining location of a locomotive 102 (broadly, an industrial machine) along a track 104 (broadly, a route for an industrial machine) according to an exemplary embodiment of the present disclosure. Although FIG. 1 illustrates a locomotive 102 along a track 104, the automated vison-based system 100 is not limited to use only with locomotives and railyard operations. In alternative embodiments, the automated vision-based system 100 may be configured for determining location of other types of industrial machines, such as overhead cranes, mining industrial machinery, stacker cranes, other mobile equipment and industrial machines used in mining, manufacturing, transportation, warehousing, etc. Accordingly, aspects of the automated vison-based system 100 are not limited to use with any one specific type of industrial machine or specific industrial application.

With continued reference to FIG. 1, the locomotive 102 generally includes a tractive effort mechanism for moving the locomotive 102 along the track 104, and a braking mechanism for reducing a speed of the locomotive 102 along the track 104.

A locomotive controller 106 (broadly, an industrial machine controller) is located onboard the locomotive 102. At least one video camera 118 is also onboard the locomotive 102. The at least one video camera 118 is generally facing towards or aligned with (e.g., forward or rearward relative to, etc.) the direction of travel for capturing video of trackside signs or vision posts 116 (e.g., sign or vision post 316 shown in FIG. 3, etc.) that the locomotive 102 passes as the locomotive 102 moves along the track 104. For example, at least one video camera may be onboard the locomotive 102 and facing forward for capturing video of signs or vision posts 116 when the locomotive 102 is travelling in a forward direction along the track 104. Also, for example, at least one video camera may be onboard a trailing end car (e.g., a caboose, locomotive, other railcar at the end of the consist, etc.), which video camera is facing rearward for capturing video of signs or vision posts 116 when the locomotive 102 is travelling in a rearward direction along the track 104.

Figure 2:
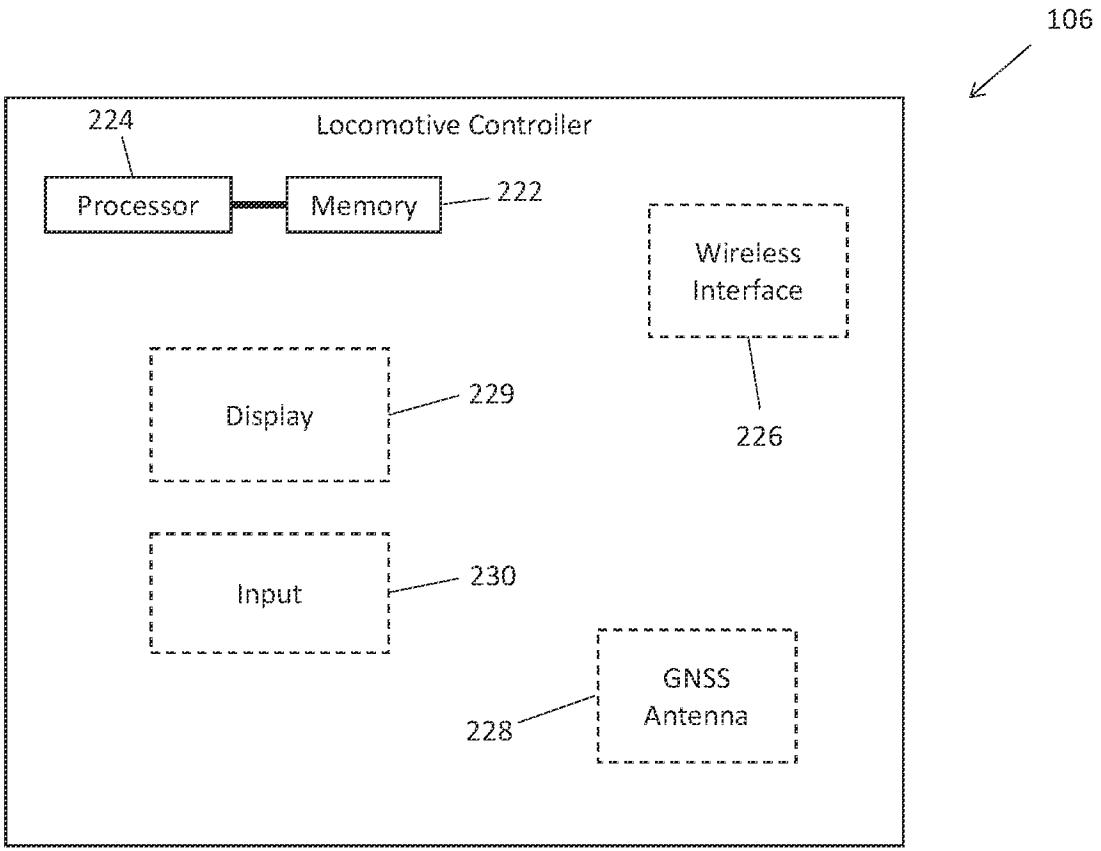
FIG. 2 is a block diagram of the locomotive controller of FIG. 1.

As shown in FIG. 2, the locomotive controller 106 includes a memory 222 to store computer-executable instructions and a processor 224 in communication with the memory 222 to execute the computer-executable instructions within the memory 222. The processor 224 is in communication (e.g., wired and/or wireless communication) with the camera 118 for receiving a video feed captured by the camera 118. The processor 224 may include or comprise an intelligent video processing unit. The processor 224 is configured for analyzing the video feed from the camera 118 to visually recognize or identify trackside signage in the video feed from the camera 118.

As shown in FIG. 1, the camera 118 may face forward relative to the direction of travel for capturing images of vision posts 116 that the locomotive passes 102 as the locomotive moves along the track 104. In other embodiments, the camera 118 may be located in any other suitable location for capturing images of vision posts 116.

With continued reference to FIG. 2, the locomotive controller 106 may further include one or more wireless interfaces 226 (e.g., data ports, etc.), such as a short-range wireless communication interface, a Wi-Fi wireless communication interface, a cellular communication interface, other radio frequency (RF) interfaces, etc. The locomotive controller 106 may also include a global navigation satellite system (GNSS) antenna 228 (e.g., a GPS antenna, etc.), one or more accelerometers (e.g., an accelerometer array, a single accelerometer, etc.), etc. The locomotive controller 106 can report a location, one or more parameters, etc. to an operator control unit (OCU) 110 (FIG. 1).

The locomotive controller 106 may include an optional display 229 and an input 230. The optional display 229 can be any suitable display (e.g., a liquid crystal display (LCD), light emitting diodes (LED), indicator lights, etc.). The input 230 can include any suitable input element(s) (e.g., a keypad, touchscreen, switches, etc.), for receiving inputs (e.g., commands, etc.) from an operator.

The locomotive controller 106 may be a remote control locomotive (RCL) controller. The operator control unit 110 includes a user interface for receiving input from an operator 114 and a wireless interface 126 in communication with the RCL controller. The operator control unit 110 may be configured to receive one or more control commands from the operator 114 via the user interface. And the operator control unit 110 may be configured to transmit the received one or more control commands to the RCL controller to control operation of the locomotive 102. The operator control unit 110 may include an enclosure (e.g., a housing) including a user interface, a display, etc. The operator control unit 110 may include a processor, battery, memory, a global navigation satellite system (GNSS) antenna (e.g., a GPS antenna, etc.), one or more accelerometers (e.g., an accelerometer array, a single accelerometer, etc.) for tilt detection, etc.

The operator control unit 110 may include a wireless interface 126 which may communicate with the locomotive controller 106 via an RF channel, etc. The operator control unit 110 may include an optional global navigation satellite system (GNSS) antenna for determining a location of the operator control unit 110. For example, the GNSS antenna may be a global positioning system (GPS) antenna. The operator control unit 110 may include a tilt sensor (e.g., an accelerometer array, a single accelerometer, etc.) for determining a tilt condition (e.g., a fall event of a field operator 114, etc.). The operator control unit 110 may include an enclosure (e.g., a housing) including the user interface, the display, etc.

Although FIG. 1 illustrates a single locomotive 102, the locomotive 102 may be part of a locomotive consist that includes one or more locomotives, rail cars, etc. coupled to the locomotive 102. If the consist includes multiple locomotives, the locomotives of the consist may operate in tandem (e.g., by remote control, etc.), and may require electrical and pneumatic connections in order to operate together. The locomotive controller 106 (e.g., a remote control locomotive (RCL) controller, etc.) may be configured to control movement of the locomotive consist along the track 104 (e.g., via a tractive effort mechanism, via a pneumatic braking system, etc.).

Similarly, although FIG. 1 illustrates a single train car 103, other embodiments may include a train having more than one train car 103 coupled to the locomotive 102, no train cars 103 coupled to the locomotive 102, etc.

In exemplary embodiments, conventional RFID transponders will each be replaced with a trackside sign, placard, or vision post. See, for example, the vision post 316 shown in FIG. 3 and described below. The vision posts may be similar to mile posts, but the vision posts may be configured to relay more precise location through visual recognition technology as disclosed herein.

The vision posts are preferably consistent in size, shape, and color scheme. But each vision post will have a unique ID that may include one or more alphanumeric characters, one or more non-numeric characters, one or more symbols (e.g., tilde —, a carat A, ampersand &, number sign #, etc.), a QR code, etc. Accordingly, a vision post may include an alphanumeric ID, a numeric ID, a non-numeric ID, an ID including symbols, an ID including a smart code, combinations thereof, etc.

In exemplary embodiments, each vision post has a four or five digit numeric ID. A prefix indicator and a suffix indicator are provided on opposite sides of the four or five digit unique numeric ID. The prefix indicator may be a single digit number, and the suffix indicator may be a single digit number. Or, for example, the prefix and suffix indicators may include one or more alphanumeric characters, one or more non-numeric characters, one or more symbols (e.g., tilde ~, a carat ˆ, ampersand &, number sign #, etc.), a QR code, etc.

Figure 3:
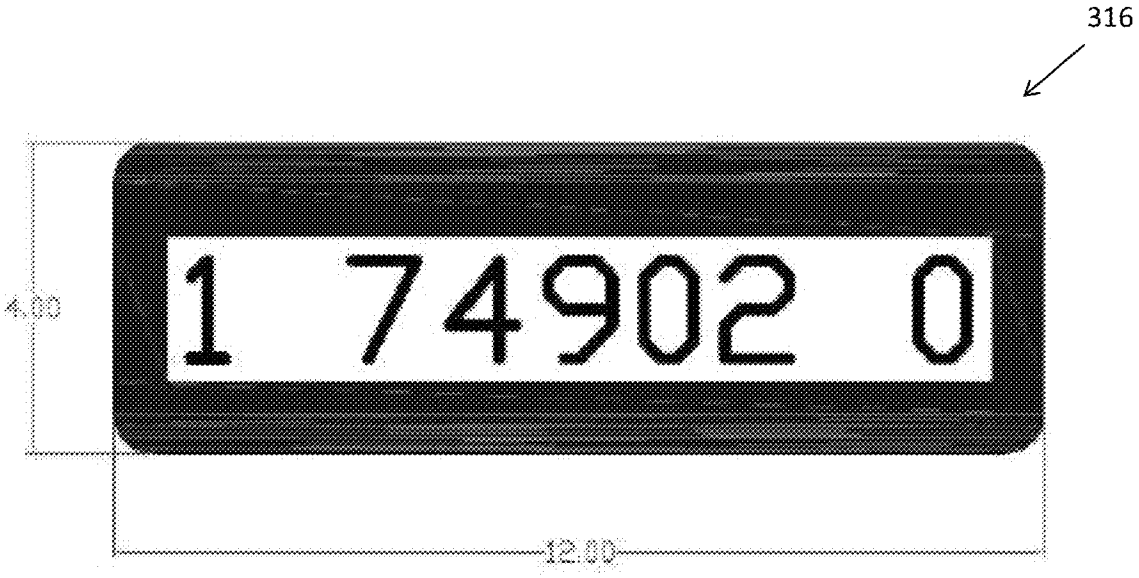
FIG. 3 illustrates an example trackside sign or vision post that may be used in exemplary embodiments of the present disclosure.

FIG. 3 illustrates an example sign or vision post 316 that may be used in exemplary embodiments, e.g., placed trackside along a locomotive track, placed along a route for an industrial machine, etc. As shown, the vision post 316 includes a five digit unique numeric ID (74902), a single digit prefix (1) and a single digit suffix (0). In this example, the vision post is four inches tall and twelve inches long. These dimension are provided for purpose of illustration only, as the trackside signs or vision posts may be larger or smaller, e.g., sufficiently large to ensure consistent reads of the unique ID of the sign from the track(s) or other industrial machine route to which it is assigned, not too large that the unique ID of the sign is captured and visually recognized from distant track(s) or distant route(s) (e.g., several tracks or routes away, etc.) to which the sign is not assigned, etc. The same dimensions are preferably used for each vision post, e.g., for reliable consistent reads, etc.

The vision post 316 preferably includes a readily distinguishable colored border (e.g., blue, etc.) around the unique ID (1 74902 0). The same color border scheme is preferably used for each vision post, and the color scheme is preferably selected with the goals of detectability and uniqueness so that other signage common to a railyard or other industrial environment is not mistakenly read.

In addition, the prefix and suffix indicators (e.g., single digit prefix, single digit suffix, alphanumeric characters, non-numeric characters, symbols, etc.) indicate the location of the active tracks (or active industrial machine route). Accordingly, the prefix and suffix indicators may thus provide a directionality indication, reduce false reads from parallel tracks, and create flexibility in installations. In exemplary embodiment, the prefix and suffix indicators include symbols (e.g., tilde ~, carat ˆ, etc.) that are less common than alphanumeric characters commonly used on trackside signage, which may further reduce false reads.

In addition to visually recognizing or identifying the unique IDs (e.g., five digit unique ID with single digit prefix and suffix, etc.) of the vision posts, the vision-based system may also be configured to monitor the direction that vision posts enter and exit the frame of vision as the locomotive or other industrial machine passes the vision posts. The direction that a vision post leaves or enters the camera's field of vision may be used with the vison post's prefix and/or suffix indicator to determine if the vison post is applicable, e.g., applicable to the track that the locomotive is using, applicable to the route the industrial machine is traveling along, etc.

For example, FIG. 4 includes a table providing an example vision post numbering system that may be used in exemplary embodiments. In FIG. 4, there is shown a full string number 0 74902 1 that includes a unique ID 74902, a prefix indicator 0, and a suffix indicator 1. The unique ID 74902 is applicable if the vision-based system (e.g., system 100 in FIG. 1, etc.) reads the unique ID and the image of the vision post exits left of frame (e.g., exits left from the field of view (FOV) of the camera 118 (FIG. 1), etc.). The image exiting to the left of frame indicates that the track and locomotive travelling along the track are to the right of the vision post. Or, in the case of an industrial machine travelling along a route, the image exiting to the left of frame indicates that the route and the industrial machine travelling along the route are to the right of the vision post.

FIG. 4 also shows full string number 1 74902 0 that includes a unique ID 74902, a prefix indicator 1, and a suffix indicator 0. The unique ID 74902 is applicable if the vision-based system (e.g., system 100 in FIG. 1, etc.) reads the unique ID and the image of the vision post exits right of frame (e.g., exits right from the field of view (FOV) of the camera 118 (FIG. 1), etc.). The image exiting to the right of frame indicates that the track and locomotive travelling along the track are to the left of the vision post. Or, in the case of an industrial machine travelling along a route, the image exiting to the right of frame indicates that the route and the industrial machine travelling along the route are to the left of the vision post.

FIG. 4 further shows full string number 1 74902 1 that includes a unique ID 74902, a prefix indicator 1, and a suffix indicator 1. The unique ID 74902 is applicable if the vision-based system (e.g., system 100 in FIG. 1, etc.) reads the unique ID and the image of the vision post exits either side of frame (e.g., exits right or left from the field of view (FOV) of the camera 118 (FIG. 1), etc.). This indicates that there are parallel PSP tracks or parallel routes in the case of an industrial machine travelling along a route.

FIG. 4 additionally shows full string number 0 74902 0 that includes a unique ID 74902, a prefix indicator 0, and a suffix indicator 0. In this example, the vision post indicates the track (or other industrial machine route) on either side of the vision post may be within PSP geofences but the tracks are not PSP tracks. In this example, the vision post with 0 74902 0 may be used instead of non-pullback transponders (NPT) that are conventionally used to indicate this through RFID.

FIG. 5 illustrates an example vision-based method for determining location of a locomotive (broadly, an industrial machine) according to an exemplary embodiment of the present disclosure. At least one video camera is onboard the locomotive. A processor is in communication (e.g., wired and/or wireless communication) with the camera for receiving and analyzing a video feed captured by the camera to visually recognize or identify vision posts (broadly, trackside signage) in the video feed from the camera.

As shown in FIG. 5, the method 500 includes, at 501, capturing video (e.g., with camera 118 (FIG. 1), etc.) of at least one trackside vision post that the locomotive passes as the locomotive moves along a track. Alternatively, the method 500 may include capturing video of at least one vision post that an industrial machine passes as the industrial machine moves along a route.

At 503, the method 500 includes analyzing the captured video feed (e.g., with a processor 224 (FIG. 1), etc.) to visually recognize the vision post in the video feed. Visually recognizing the vision post includes identifying a unique ID, prefix indicator, and suffix indicator of the vision post.

At 505, the method 500 includes determining a left or right direction in which the image of the vision post exits the frame (e.g., exits the field of view of the camera 118 (FIG. 1), etc.).

At 507, the method 500 includes determining whether or not data on the vision post is applicable to the occupied track (or other occupied industrial machine route) by using the left or right direction that the image exits the frame in tandem with the prefix and/or suffix indicators of the vision post.

Exemplary embodiments of the vision-based systems and methods disclosed herein may be included, implemented, and/or combined with pullback stopping protection (PSP) systems. Conventional pullback stopping protection (PSP) systems use RFID track transponders and system odometer readings for primary location determination, with geofence overlays for maximum entry and exit speed definition to supplement the RFID transponder data. The RFID transponder values are unique and have attributes associated to the RFID transponders that can include push speed limit, pull speed limit, train brake reduction value, distance to next transponder, and others. The data relayed by the RFID track transponders to the PSP system provide an indication of the locomotive location in the yard. But as disclosed herein, the conventional RFID transponders may be replaced with trackside signs or vision posts that are configured to relay precise locomotive location information through visual recognition technology, e.g., a front-face camera and processing unit onboard the locomotive.

By way of example, FIG. 6 illustrates an example of pullback stopping protection (PSP) and illustrating trackside signs or vision posts spaced apart along the pullback track. The trackside signs or vision posts define PSP zones along the track. See, for example, FIGS. 7 and 8 illustrating examples PSP zones for the same track that may be defined by trackside signs or vision posts. Each PSP zone is generally defined by two points and a width. More specifically, the two points are midway through the vertical lines, and the width or distance between the two points defines a total height of the zone. The two points are processed as being directly with the extents of the zone extending by the defined width, which enables the PSP zones to cover adjacent, non-pullback tracks.

As noted above, exemplary embodiments of the vision-based systems and methods disclosed herein may be included, implemented, and/or combined with pullback stopping protection (PSP) systems. In exemplary embodiments, the PSP system may be an automated, self-activating, dual redundant, control system that provides pullback stopping protection (PSP). The PSP system may permit crew members to stay on the car side of the switching operation while the remote controlled locomotive is forced to follow a stopping trajectory without requiring point protection from an operator.

The stopping trajectory is the deceleration profile produced by a series of strategically placed trackside signs or vision posts to progressively reduce movement speed (at each successive transponder) throughout the length of the pullback track, culminating in a protective stop at the (zero speed) end of the pullback trackside sign or placard.

The PSP system may be configured such that the locomotive is alert to its approach to a pullback track entry and will self-activate the pullback stopping protection (PSP) functionality when the processor visually recognizes or identifies an entry/exit trackside sign or vision post onto the pullback track in the video feed from the front-facing camera.

During PSP activation, a maximum allowable speed is set according to the stopping trajectory, thereby overriding any OCU commanded higher speed. But any OCU commanded speed that is lower than the stopping trajectory set point is recognized as the operative movement speed.

In exemplary embodiments, PSP redundancy control may be provided in the form of two independent control subsystems, specifically a primary subsystem and a secondary GPS subsystem. The primary subsystem uses a front-facing camera onboard the locomotive and a processor for visual recognition or identification of trackside signs or vision posts to reduce movement speed in compliance with a stopping trajectory. The secondary GPS subsystem provides real-time interactive computation of RCL speed, direction, and position for supervisory verification of RCL compliance with the stopping trajectory. The GPS subsystem contains a GPS Region/Sub Map/Sub Zone mapping hierarchy that allows for PSP supervision on all pullback tracks within a region, e.g., a company region, etc.

In exemplary embodiments, the vision posts are used as indicators alongside a track or other industrial machine route. The payload data shown on these vison posts include a unique ID plus a suffix and a prefix. As disclosed herein, the payload data on the vision posts may include a unique ID comprised of one or more alphanumeric characters (e.g., 74902 (FIG. 3), etc.), one or more non-numeric characters, one or more symbols (e.g., tilde ~, a carat ˆ, ampersand &, number sign #, etc.), a QR code, etc. The prefix and suffix may include one or more alphanumeric characters, one or more numeric digits (e.g., 0, 1, etc.), one or more non-numeric characters, one or more symbols (e.g., tilde —, a carat A ampersand &, number sign #, etc.), a QR code, etc.

The suffix and prefix on a vision post are interpretable by the visual recognition AI to indicate whether or not the payload data on the vision post is applicable to the occupied track. The direction at which the vision post enters or leaves the field of view of the camera system is used in tandem with the suffix or prefix.

In exemplary embodiments, the unique ID of the payload data on a vision post is part of a binary map file in the RCL system. If the unique ID is read and found to be part of the binary map file and expected to be the next value, the RCL system will apply attributes associated with the unique ID to the movement. Attributes could be maximum push speed, maximum pull speed, train brake reduction, an alert (e.g., bell/horn alert, etc.), and/or other attributes. This architecture helps to ensure that misread strings of the payload data on vision posts are not a safety concern in exemplary embodiments. For example, if an incorrect string is read from a vision post, the misread string either will not be in the binary map or the current locomotive location based on GPS subzone and odometer values will not indicate that the payload data was expected so the misread string of the payload data will be disregarded.

In exemplary embodiments, the system also maintains an odometer, which is used as an additional layer of safety and verification. The binary map of the PSP tracks includes expected distances between vision posts. One of the ways that this adds safety is to protect against missed reads of vision posts, either through damage to the post, a failure in the AI or through a track switch setting the locomotive onto an unprotected track. In the event that the system odometer exceeds any distance defined in the binary map for that section of track, the RCL system will generate a safe stop to prevent overrunning the pullback track.

In exemplary embodiments, the trackside signage comprises existing track identifying signage positioned along the track. In such exemplary embodiments, the at least one camera is positionable onboard the locomotive for capturing one or more images of the existing track identifying signage positioned along the track. The at least one processor is configured to analyze the one or more images and visually recognize the existing track identifying signage to thereby identify the track(s) corresponding with the existing track identifying signage. Accordingly, the system/method may rely upon the existing trackside signage previously positioned at locations along the track such that new vision posts are not necessarily required to be installed along PSP tracks. In the yard, for example, the tracks are typically numbered and sometimes have small signs to indicate the track number. In which case, a system disclosed herein may be configured to visually recognize these signs and associate the signs with GPS coordinates, which is then used as part of the location determination. An odometer may then be used for location tracking until the locomotive arrives at the next sign.

Accordingly, exemplary embodiments are disclosed herein of automated vision-based systems for locomotive location determination. In exemplary embodiments, the system includes at least one camera positionable onboard a locomotive for capturing one or more images of trackside signage including location data corresponding with location(s) along a track. The system also includes at least one processor configured for communication with the at least one camera for receiving the one or more images of the trackside signage captured by the at least one camera. The at least one processor is configured to analyze the one or more images and visually recognize the location data of the trackside signage in the one or more images captured by the at least one camera, thereby enabling the system to identify the locomotive's location along the track via the at least one processor's visual recognition of the location data of the trackside signage.

In exemplary embodiments, the location data visually recognizable in the one or more images of the trackside signage is usable for pullback stopping protection (PSP) functionality.

In exemplary embodiments, the system includes an automated locomotive speed control system for the locomotive. The automated locomotive speed control system includes a tractive effort mechanism for moving the locomotive along the track, a braking mechanism for reducing a speed of the locomotive along the track, and a locomotive controller including the at least one processor. The automated locomotive speed control system may be configured to control the locomotive according to a stopping trajectory along a pullback track that is implemented through the placement of the trackside signage and an overlay of geofences. The system may be configured to enforce a continually descending speed limit to bring the locomotive to a stop before a predetermined point on the pullback track. The system may include the locomotive including the at least one camera and the locomotive controller onboard the locomotive, the tractive effort mechanism for moving the locomotive along the track, and the braking mechanism for reducing the speed of the locomotive along the track.

In exemplary embodiments, the at least one camera includes at least one video camera positionable onboard the locomotive for capturing video of the trackside signage including the location data of the trackside signage. And the at least one processor is configured for communication with the at least one video camera for receiving a video feed captured by the at least one video camera. The at least one processor is configured to analyze the video feed and visually recognize the location data of the trackside signage in the video feed.

In exemplary embodiments, the system includes the trackside signage including a plurality of trackside signs each including location data in the form of an identification to which has been associated one or more attributes for enforcing a stopping trajectory. Each trackside sign may include a numeric identification, an alphanumeric identification, or a non-numeric identification including one or more symbols. For example, each trackside sign may include a 4 or 5 digit numeric identification.

In exemplary embodiments, each trackside sign further includes a prefix indicator and a suffix indicator. And the system is configured to determine a left or right direction in which a trackside sign leaves or enters the at least one camera's field of vision and to thereafter use the determined left or right direction with the trackside sign's prefix indicator and/or suffix indicator to determine if the trackside sign is applicable to the occupied track that the locomotive is using. The prefix indicator may include one or more alphanumeric characters, one or more non-numeric characters, and/or one or more symbols. And the suffix indicator may include one or more alphanumeric characters, one or more non-numeric characters, and/or one or more symbols. For example, the prefix indicator may be a single numeric digit, and the suffix indicator may be a single numeric digit.

In exemplary embodiments, the system is configured to determine that: a trackside sign is applicable when the prefix indicator is a first character/symbol, the suffix indicator is a second character/symbol, and the image(s) of the trackside sign exits left of frame thereby meaning the track is to the right of the trackside sign; a trackside sign is applicable when the prefix indicator is the second character/symbol, the suffix indicator is the first character/symbol, and the image of the trackside sign exits right of frame thereby meaning the track is to the left of the trackside sign; and a trackside sign is applicable when the prefix indicator is the second character/symbol, the suffix indicator is the second character/symbol, and the image of the trackside sign exits left or right of frame thereby meaning there are parallel pullback stopping protection (PSP) tracks.

In exemplary embodiments, the system is configured to determine that a trackside sign is applicable when the prefix indicator is 0, the suffix indicator is 1, and the image(s) of the trackside sign exits left of frame thereby meaning the track is to the right of the trackside sign. The system is also configured to determine that a trackside sign is applicable when the prefix indicator is 1, the suffix indicator is 0, and the image of the trackside sign exits right of frame thereby meaning the track is to the left of the trackside sign. The system is further configured to determine that a trackside sign is applicable when the prefix indicator is 1, the suffix indicator is 1, and the image of the trackside sign exits left or right of frame thereby meaning there are parallel pullback stopping protection (PSP) tracks.

In exemplary embodiments, each trackside sign includes a same colored border around the identification of the trackside sign.

In exemplary embodiments, the location data of a trackside sign includes payload data including an identification, a prefix indicator, and a suffix indicator. The identification of the payload data on a trackside sign may be part of a binary map file in a remote control locomotive (RCL) system for the locomotive. When the identification of the payload data on the trackside sign is read and found to be part of the binary map and expected to be the next value, the RCL system may be configured to apply one or more attributes associated with the identification of the payload data on the trackside sign for controlling operation of the locomotive. For example, the RCL system may be configured to apply one or more of maximum push speed, maximum pull speed, train brake reduction, and/or alert (e.g., bell/horn alert, etc.) when the identification of the payload data on the trackside sign is read and found to be part of the binary map and expected to be the next value. The system may be configured such that if an incorrect string is read from a vision post: the misread string will not be in the binary map; or the current locomotive location based on GPS subzone and odometer values will not indicate that the payload data was expected so the misread string of the payload data will be disregarded.

In exemplary embodiments, the at least one processor includes an intelligent video processing unit.

In exemplary embodiments, the trackside signage includes existing track identifying signage positioned along the track. At least one camera is positionable onboard the locomotive for capturing one or more images of the existing track identifying signage positioned along the track. At least one processor is configured to analyze the one or more images and visually recognize the existing track identifying signage to thereby identify the track(s) corresponding with the existing track identifying signage.

In exemplary embodiments, the system is configured to associate GPS coordinates with a visually recognized trackside sign to thereby determine location of the locomotive. The system is also configured to use an odometer for location tracking of the locomotive along the track until the locomotive arrives at a next trackside sign.

Also disclosed are exemplary methods of determining location of a locomotive along a track. In exemplary embodiments, the method includes capturing, via at least one camera onboard the locomotive, one or more images of trackside signage including location data that corresponds with location(s) along the track. The method further includes visually recognizing, via at least one processor onboard the locomotive, the location data of the trackside signage in the one or more images captured via the at least one camera, to thereby identify the locomotive's location along the track.

In exemplary embodiments, the method includes positioning the trackside signage at locations along the track corresponding with the location data of the trackside signage.

In exemplary embodiments, the method includes positioning the trackside signage along the track to define one or more pullback stopping protection (PSP) zones. The location data visually recognizable in the one or more images of the trackside signage is usable for pullback stopping protection (PSP) functionality.

In exemplary embodiments, the method includes controlling the locomotive according to a stopping trajectory including a continually descending speed limit along a pullback track that is implemented through the placement of the trackside signage and an overlay of geofences, such that the locomotive is stopped before a predetermined point on the pullback track.

In exemplary embodiments, the method includes capturing, via at least one video camera onboard the locomotive, video of the trackside signage including the location data of the trackside signage. The method further includes visually recognizing, via the at least one processor onboard the locomotive, the location data of the trackside signage in a video feed captured by the at least one video camera.

In exemplary embodiments, the trackside signage includes a plurality of trackside signs each including location data in the form of an identification to which has been associated one or more attributes for enforcing a stopping trajectory. Each trackside sign may include a numeric identification, an alphanumeric identification, or a non-numeric identification including one or more symbols. For example, each trackside sign may include a 4 or 5 digit numeric identification.

In exemplary embodiments, each trackside sign further includes a prefix indicator and a suffix indicator. And the method includes determining a left or right direction in which a trackside sign leaves or enters the at least one camera's field of vision and thereafter using the determined left or right direction with the trackside sign's prefix indicator and/or suffix indicator to determine if the trackside sign is applicable to the occupied track that the locomotive is using. The prefix indicator may include one or more alphanumeric characters, one or more non-numeric characters, and/or one or more symbols. And the suffix indicator may include one or more alphanumeric characters, one or more non-numeric characters, and/or one or more symbols. For example, the prefix indicator may be a single numeric digit, and the suffix indicator may be a single numeric digit.

In exemplary embodiments, the method includes determining that: a trackside sign is applicable when the prefix indicator is a first character/symbol, the suffix indicator is a second character/symbol, and the image(s) of the trackside sign exits left of frame thereby meaning the track is to the right of the trackside sign; a trackside sign is applicable when the prefix indicator is the second character/symbol, the suffix indicator is the first character/symbol, and the image of the trackside sign exits right of frame thereby meaning the track is to the left of the trackside sign; and a trackside sign is applicable when the prefix indicator is the second character/symbol, the suffix indicator is the second character/symbol, and the image of the trackside sign exits left or right of frame thereby meaning there are parallel pullback stopping protection (PSP) tracks.

In exemplary embodiments, the method includes determining that a trackside sign is applicable when the prefix indicator is 0, the suffix indicator is 1, and the image(s) of the trackside sign exits left of frame thereby meaning the track is to the right of the trackside sign. The method also includes determining a trackside sign is applicable when the prefix indicator is 1, the suffix indicator is 0, and the image of the trackside sign exits right of frame thereby meaning the track is to the left of the trackside sign. The method further includes determining that a trackside sign is applicable when the prefix indicator is 1, the suffix indicator is 1, and the image of the trackside sign exits left or right of frame thereby meaning there are parallel pullback stopping protection (PSP) tracks.

In exemplary embodiments, each trackside sign includes a same colored border around the identification of the trackside sign.

In exemplary embodiments, the location data of a trackside sign includes payload data including an identification, a prefix indicator, and a suffix indicator. The identification of the payload data on a trackside sign may be part of a binary map file. And the method includes when the identification of the payload data on the trackside sign is read and found to be part of the binary map and expected to be the next value, applying one or more attributes associated with the identification of the payload data on the trackside sign for controlling operation of the locomotive. For example, the method may include applying one or more of maximum push speed, maximum pull speed, train brake reduction, and/or alert (e.g., bell/horn alert, etc.) when the identification of the payload data on the trackside sign is read and found to be part of the binary map and expected to be the next value. If an incorrect string is read from a vision post, the method may include determining that the misread string is not in the binary map; or disregarding the misread string after determining that the current locomotive location based on GPS subzone and odometer values does not indicate that the payload data was expected.

In exemplary embodiments, the trackside signage includes existing track identifying signage positioned along the track. And the method includes capturing, via the at least one camera onboard the locomotive, one or more images of the existing track identifying signage positioned along the track. The method also includes visually recognizing, via the at least one processor onboard the locomotive, the existing track identifying signage to thereby identify the track(s) corresponding with the existing track identifying signage.

In exemplary embodiments, the method includes associating GPS coordinates with a visually recognized trackside sign to thereby determine location of the locomotive. The method also includes using an odometer for location tracking of the locomotive along the track until the locomotive arrives at a next trackside sign.

Exemplary embodiments of locomotive controllers are also disclosed herein. In exemplary embodiments, a locomotive controller includes memory configured to store computer-executable instructions. The locomotive controller further includes at least one processor configured for communication with at least one camera positionable onboard a locomotive for receiving one or more images of trackside signage captured by the at least one camera. The processor is in communication with the memory to execute the computer-executable instructions to visually recognize location data of the trackside signage in the one or more images captured via the at least one camera to thereby identify the locomotive's location along the track.

In exemplary embodiments, the locomotive controller is configured to be operable for controlling a tractive effort mechanism for moving the locomotive along the track and a braking mechanism for reducing a speed of the locomotive along the track. The locomotive controller is configured to control the locomotive according to a stopping trajectory along a pullback track that is implemented through the placement of the trackside signage and an overlay of geofences. The locomotive controller is configured to enforce a continually descending speed limit to bring the locomotive to a stop before a predetermined point on the pullback track.

In exemplary embodiments, the at least one processor is configured for communication with at least one video camera positionable onboard the locomotive for receiving a video feed captured by the at least one video camera. And the at least one processor is configured to analyze the video feed and visually recognize the location data of the trackside signage in the video feed.

In exemplary embodiments, the locomotive controller is configured to determine a left or right direction in which a trackside sign leaves or enters the at least one camera's field of vision and to thereafter use the determined left or right direction with a trackside sign's prefix indicator and/or suffix indicator to determine if the trackside sign is applicable to the occupied track that the locomotive is using.

In exemplary embodiments, the locomotive controller is configured to determine that: a trackside sign is applicable when the prefix indicator is a first character/symbol, the suffix indicator is a second character/symbol, and the image(s) of the trackside sign exits left of frame thereby meaning the track is to the right of the trackside sign; a trackside sign is applicable when the prefix indicator is the second character/symbol, the suffix indicator is the first character/symbol, and the image of the trackside sign exits right of frame thereby meaning the track is to the left of the trackside sign; and a trackside sign is applicable when the prefix indicator is the second character/symbol, the suffix indicator is the second character/symbol, and the image of the trackside sign exits left or right of frame thereby meaning there are parallel pullback stopping protection (PSP) tracks.

In exemplary embodiments, the locomotive controller is configured to determine that: a trackside sign is applicable when the prefix indicator is 0, the suffix indicator is 1, and the image(s) of the trackside sign exits left of frame thereby meaning the track is to the right of the trackside sign; a trackside sign is applicable when the prefix indicator is 1, the suffix indicator is 0, and the image of the trackside sign exits right of frame thereby meaning the track is to the left of the trackside sign; and a trackside sign is applicable when the prefix indicator is 1, the suffix indicator is 1, and the image of the trackside sign exits left or right of frame thereby meaning there are parallel pullback stopping protection (PSP) tracks.

In exemplary embodiments, the locomotive controller is configured to apply one or more attributes associated with an identification of payload data on a trackside sign for controlling operation of the locomotive when the identification of the payload data on the trackside sign is read and found to be part of a binary map and expected to be a next value. In such exemplary embodiments, the locomotive controller may be configured to apply one or more of maximum push speed, maximum pull speed, train brake reduction, and/or an alert, when the identification of the payload data on the trackside sign is read and found to be part of the binary map and expected to be the next value. Additionally, or alternatively, the locomotive controller may be configured to such that if an incorrect string is read from a vision post: the misread string will not be in the binary map; or the current locomotive location based on GPS subzone and odometer values will not indicate that the payload data was expected so the misread string of the payload data will be disregarded.

In exemplary embodiments, the locomotive controller is configured to associate GPS coordinates with a visually recognized trackside sign to thereby determine location of the locomotive and to use an odometer for location tracking of the locomotive along the track until the locomotive arrives at a next trackside sign.

In exemplary embodiments, the at least one processor of the locomotive controller includes an intelligent video processing unit.

Exemplary embodiments are disclosed herein of automated vision-based systems for industrial machine location determination. In exemplary embodiments, the system includes at least one camera positionable onboard an industrial machine for capturing one or more images of signage alongside a route for the industrial machine. The signage includes location data corresponding with location(s) along the route. The system further includes at least one processor configured for communication with the at least one camera for receiving the one or more images of the signage captured by the at least one camera. The at least one processor is configured to analyze the one or more images and visually recognize the location data of the signage in the one or more images captured by the at least one camera, thereby enabling the system to identify the industrial machine's location along the route via the at least one processor's visual recognition of the location data of the signage.

In exemplary embodiments, the at least one camera includes at least one video camera positionable onboard the industrial machine for capturing video of the signage including the location data of the signage. And the at least one processor is configured for communication with the at least one video camera for receiving a video feed captured by the at least one video camera, the at least one processor configured to analyze the video feed and visually recognize the location data of the signage in the video feed.

In exemplary embodiments, the system includes the signage including a plurality of signs. Each sign includes location data in the form of an identification to which has been associated one or more attributes for enforcing a stopping trajectory for the industrial machine. In such exemplary embodiments, each sign includes a numeric identification, an alphanumeric identification, or a non-numeric identification including one or more symbols. Each sign further includes a prefix indicator and a suffix indicator. And the system is configured to determine a left or right direction in which a sign leaves or enters the at least one camera's field of vision and to thereafter use the determined left or right direction with the sign's prefix indicator and/or suffix indicator to determine if the sign is applicable to the occupied route that the industrial machine is using. The prefix indicator may be a single numeric digit, and the suffix indicator is a single numeric digit. Or, the prefix indicator may include one or more alphanumeric characters, one or more non-numeric characters, and/or one or more symbols. And the suffix indicator may include one or more alphanumeric characters, one or more non-numeric characters, and/or one or more symbols.

In exemplary embodiments, the system is configured to determine that: a sign is applicable when the prefix indicator is a first character/symbol, the suffix indicator is a second character/symbol, and the image(s) of the sign exits left of frame thereby meaning the route is to the right of the sign; a sign is applicable when the prefix indicator is the second character/symbol, the suffix indicator is the first character/symbol, and the image of the sign exits right of frame thereby meaning the route is to the left of the sign; and a sign is applicable when the prefix indicator is the second character/symbol, the suffix indicator is the second character/symbol, and the image of the sign exits left or right of frame thereby meaning there are parallel routes.

In exemplary embodiments, the system is configured to determine that: a sign is applicable when the prefix indicator is 0, the suffix indicator is 1, and the image(s) of the sign exits left of frame thereby meaning the route is to the right of the sign; a sign is applicable when the prefix indicator is 1, the suffix indicator is 0, and the image of the sign exits right of frame thereby meaning the route is to the left of the sign; and a sign is applicable when the prefix indicator is 1, the suffix indicator is 1, and the image of the sign exits left or right of frame thereby meaning there are parallel routes.

In exemplary embodiments, each sign includes a same colored border around the identification of the sign.

In exemplary embodiments, the location data of a sign includes payload data including an identification, a prefix indicator, and a suffix indicator. The identification of the payload data on a sign is part of a binary map file for the industrial machine. When the identification of the payload data on the sign is read and found to be part of the binary map and expected to be the next value, the system is configured to apply one or more attributes associated with the identification of the payload data on the sign for controlling operation of the industrial machine. The system may be configured to apply one or more of maximum push speed, maximum pull speed, brake reduction, brake increase, and/or an alert, when the identification of the payload data on the sign is read and found to be part of the binary map and expected to be the next value. Additionally, or alternatively, the system may be configured such that if an incorrect string is read from a vision post: the misread string will not be in the binary map; or the current industrial machine location based on GPS subzone and odometer values will not indicate that the payload data was expected so the misread string of the payload data will be disregarded.

In exemplary embodiments, the at least one processor includes an intelligent video processing unit.

In exemplary embodiments, the system is configured to associate GPS coordinates with a visually recognized sign to thereby determine location of the industrial machine and to use an odometer for location tracking of the industrial machine along the route until the industrial machine arrives at a next sign.

Also disclosed are exemplary methods of determining location of an industrial machine along a route. In exemplary embodiments, the method includes capturing, via at least one camera onboard an industrial machine, one or more images of signage alongside a route for the industrial machine. The signage includes location data that corresponds with location(s) along the route. The method also includes visually recognizing, via at least one processor onboard the industrial machine, the location data of the signage in the one or more images captured via the at least one camera, to thereby identify the industrial machine's location along the route.

In exemplary embodiments, the method includes positioning the signage at locations alongside the route corresponding with the location data of the signage.

In exemplary embodiments, the method includes controlling the industrial machine according to a stopping trajectory including a continually descending speed limit along the route that is implemented through the placement of the signage and an overlay of geofences, such that the industrial machine is stopped before a predetermined point along the route.

In exemplary embodiments, the method includes: capturing, via at least one video camera onboard the industrial machine, video of the signage including the location data of the signage; and visually recognizing, via the at least one processor onboard the industrial machine, the location data of the signage in a video feed captured by the at least one video camera.

In exemplary embodiments, the signage includes a plurality of signs. Each sign includes location data in the form of an identification to which has been associated one or more attributes for enforcing a stopping trajectory. Each sign includes a numeric identification, an alphanumeric identification, or a non-numeric identification including one or more symbols. Each sign further includes a prefix indicator and a suffix indicator. Each sign includes a same colored border around the identification of the sign.

In exemplary embodiments, the method includes determining a left or right direction in which a sign leaves or enters the at least one camera's field of vision and thereafter using the determined left or right direction with the sign's prefix indicator and/or suffix indicator to determine if the sign is applicable to the occupied route that the industrial machine is using.

In exemplary embodiments, the method includes determining that: a sign is applicable when the prefix indicator is a first character/symbol, the suffix indicator is a second character/symbol, and the image(s) of the sign exits left of frame thereby meaning the route is to the right of the sign; a sign is applicable when the prefix indicator is the second character/symbol, the suffix indicator is the first character/symbol, and the image of the sign exits right of frame thereby meaning the route is to the left of the sign; and a sign is applicable when the prefix indicator is the second character/symbol, the suffix indicator is the second character/symbol, and the image of the sign exits left or right of frame thereby meaning there are parallel routes.

In exemplary embodiments, the method includes determining that: a sign is applicable when the prefix indicator is 0, the suffix indicator is 1, and the image(s) of the sign exits left of frame thereby meaning the route is to the right of the sign; a sign is applicable when the prefix indicator is 1, the suffix indicator is 0, and the image of the sign exits right of frame thereby meaning the route is to the left of the sign; and a sign is applicable when the prefix indicator is 1, the suffix indicator is 1, and the image of the sign exits left or right of frame thereby meaning there are parallel routes.

In exemplary embodiments, the location data of a sign includes payload data including an identification, a prefix indicator, and a suffix indicator. The identification of the payload data on a sign is part of a binary map file. And the method includes when the identification of the payload data on the sign is read and found to be part of the binary map and expected to be the next value, applying one or more attributes associated with the identification of the payload data on the sign for controlling operation of the industrial machine. The method may include applying one or more of maximum push speed, maximum pull speed, brake reduction, brake increase, and/or an alert when the identification of the payload data on the sign is read and found to be part of the binary map and expected to be the next value. Additionally, or alternatively, the method may include if an incorrect string is read from a vision post: determining that the misread string is not in the binary map; or disregarding the misread string after determining that the current industrial machine location based on GPS subzone and odometer values does not indicate that the payload data was expected.

In exemplary embodiments, the method includes: associating GPS coordinates with a visually recognized sign to thereby determine location of the industrial machine; and using an odometer for location tracking of the industrial machine along the route until the industrial machine arrives at a next sign.

Exemplary embodiments of industrial machine controllers are also disclosed herein. In exemplary embodiments, an industrial machine controller includes a memory configured to store computer-executable instructions. The industrial machine controller further includes at least one processor configured for communication with at least one camera positionable onboard an industrial machine for receiving one or more images of signage alongside a route for the industrial machine that are captured by the at least one camera. The processor is in communication with the memory to execute the computer-executable instructions to visually recognize location data of the signage in the one or more images captured via the at least one camera to thereby identify the industrial machine's location along the route.

In exemplary embodiments, the industrial machine controller is configured to be operable for controlling the industrial machine according to a stopping trajectory that is implemented through the placement of the signage and an overlay of geofences, whereby the industrial machine controller is configured to enforce a continually descending speed limit along the route to bring the industrial machine to a stop before a predetermined point along the route.

In exemplary embodiments, the at least one processor is configured for communication with at least one video camera positionable onboard the industrial machine for receiving a video feed captured by the at least one video camera. And the at least one processor is configured to analyze the video feed and visually recognize the location data of the signage in the video feed.

In exemplary embodiments, the industrial machine controller is configured to determine a left or right direction in which a sign leaves or enters the at least one camera's field of vision and to thereafter use the determined left or right direction with a sign's prefix indicator and/or suffix indicator to determine if the sign is applicable to the occupied route that the industrial machine is using.

In exemplary embodiments, the industrial machine controller is configured to determine that: a sign is applicable when the prefix indicator is a first character/symbol, the suffix indicator is a second character/symbol, and the image(s) of the sign exits left of frame thereby meaning the route is to the right of the sign; a sign is applicable when the prefix indicator is the second character/symbol, the suffix indicator is the first character/symbol, and the image of the sign exits right of frame thereby meaning the route is to the left of the sign; and a sign is applicable when the prefix indicator is the second character/symbol, the suffix indicator is the second character/symbol, and the image of the sign exits left or right of frame thereby meaning there are parallel routes.

In exemplary embodiments, the industrial machine controller is configured to determine that: a sign is applicable when the prefix indicator is 0, the suffix indicator is 1, and the image(s) of the sign exits left of frame thereby meaning the route is to the right of the sign; a sign is applicable when the prefix indicator is 1, the suffix indicator is 0, and the image of the sign exits right of frame thereby meaning the route is to the left of the sign; and a sign is applicable when the prefix indicator is 1, the suffix indicator is 1, and the image of the sign exits left or right of frame thereby meaning there are parallel routes.

In exemplary embodiments, the industrial machine controller is configured to apply one or more attributes associated with an identification of payload data on a sign for controlling operation of the industrial machine when the identification of the payload data on the sign is read and found to be part of a binary map and expected to be a next value. The industrial machine controller may be configured to apply one or more of maximum push speed, maximum pull speed, brake reduction, brake increase, and/or an alert, when the identification of the payload data on the sign is read and found to be part of the binary map and expected to be the next value. Additionally, or alternatively, the industrial machine controller may be configured to such that if an incorrect string is read from a vision post: the misread string will not be in the binary map; or the current industrial machine location based on GPS subzone and odometer values will not indicate that the payload data was expected so the misread string of the payload data will be disregarded.

In exemplary embodiments, the industrial machine controller is configured to associate GPS coordinates with a visually recognized sign to thereby determine location of the industrial machine and to use an odometer for location tracking of the industrial machine along the route until the industrial machine arrives at a next sign.

In exemplary embodiments, the at least one processor of the industrial machine controller includes an intelligent video processing unit.

Although various exemplary embodiments are disclosed with reference to locomotives and railyard operations, aspects of the present disclosure are limited to use with only locomotives in railyard operations. Instead, aspects of the present disclosure may be practiced in connection with various types of industrial machines in various types of environments, e.g., overhead cranes, mining industrial machinery, stacker cranes, other mobile equipment and industrial machines used in mining, manufacturing, transportation, warehousing, etc. Accordingly, aspects of the present disclosure are not limited to use with any one specific type of industrial machine for any one specific type of application.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An automated vision-based system for locomotive location determination, the system comprising:

at least one camera positionable onboard a locomotive for capturing one or more images of trackside signage including location data corresponding with location(s) along a track; and at least one processor configured for communication with the at least one camera for receiving the one or more images of the trackside signage captured by the at least one camera, the at least one processor configured to analyze the one or more images and visually recognize the location data of the trackside signage in the one or more images captured by the at least one camera, thereby enabling the system to identify the locomotive's location along the track via the at least one processor's visual recognition of the location data of the trackside signage;

wherein the system comprises an automated locomotive speed control system for the locomotive including:

a tractive effort mechanism for moving the locomotive along the track;

a braking mechanism for reducing a speed of the locomotive along the track; and a locomotive controller including the at least one processor;

wherein the automated locomotive speed control system is configured to control the locomotive according to a stopping trajectory along a pullback track that is implemented through the placement of the trackside signage and an overlay of geofences, whereby the system is configured to enforce a continually descending speed limit to bring the locomotive to a stop before a predetermined point on the pullback track.

2. The system of claim 1, wherein location data visually recognizable in the one or more images of the trackside signage is usable for pullback stopping protection (PSP) functionality.

3. The system of claim 1, wherein:

the at least one camera comprises at least one video camera positionable onboard the locomotive for capturing video of the trackside signage including the location data of the trackside signage; and the at least one processor is configured for communication with the at least one video camera for receiving a video feed captured by the at least one video camera, the at least one processor configured to analyze the video feed and visually recognize the location data of the trackside signage in the video feed.

4. The system of claim 1, wherein the system comprises the trackside signage including a plurality of trackside signs each including location data in the form of an identification to which has been associated one or more attributes for enforcing a stopping trajectory.

5. The system of claim 4, wherein each said trackside sign includes a same colored border around the identification of the trackside sign.

6. The system of claim 1, wherein the at least one processor comprises an intelligent video processing unit.

7. The system of claim 1, wherein:

the trackside signage comprises existing track identifying signage positioned along the track;

the at least one camera is positionable onboard the locomotive for capturing one or more images of the existing track identifying signage positioned along the track; and the at least one processor is configured to analyze the one or more images and visually recognize the existing track identifying signage to thereby identify the track corresponding with the existing track identifying signage from a plurality of tracks.

8. The system of claim 1, wherein the system is configured to associate GPS coordinates with a visually recognized trackside sign to thereby determine location of the locomotive and to use an odometer for location tracking of the locomotive along the track until the locomotive arrives at a next trackside sign.

9. An automated vision-based system for locomotive location determination, the system comprising:

at least one camera positionable onboard a locomotive for capturing one or more images of trackside signage including location data corresponding with location(s) along a track; and at least one processor configured for communication with the at least one camera for receiving the one or more images of the trackside signage captured by the at least one camera, the at least one processor configured to analyze the one or more images and visually recognize the location data of the trackside signage in the one or more images captured by the at least one camera, thereby enabling the system to identify the locomotive's location along the track via the at least one processor's visual recognition of the location data of the trackside signage;

wherein:

the trackside signage includes a plurality of trackside signs each including location data in the form of an identification to which has been associated one or more attributes for enforcing a stopping trajectory;

each said trackside sign includes a numeric identification, an alphanumeric identification, or a non-numeric identification including one or more symbols;

each said trackside sign further includes a prefix indicator and a suffix indicator; and the system is configured to determine a left or right direction in which a trackside sign leaves or enters the at least one camera's field of vision and to thereafter use the determined left or right direction with the trackside sign's prefix indicator and/or suffix indicator to determine if the trackside sign is applicable to the track that the locomotive is using.

10. The system of claim 9, wherein the system comprises an automated locomotive speed control system for the locomotive including:

a tractive effort mechanism for moving the locomotive along the track;

a braking mechanism for reducing a speed of the locomotive along the track; and a locomotive controller including the at least one processor;

wherein the automated locomotive speed control system is configured to control the locomotive according to a stopping trajectory along a pullback track that is implemented through the placement of the trackside signage and an overlay of geofences, whereby the system is configured to enforce a continually descending speed limit to bring the locomotive to a stop before a predetermined point on the pullback track.

11. The system of claim 9, wherein:

the prefix indicator is a single numeric digit, and the suffix indicator is a single numeric digit; or the prefix indicator includes one or more alphanumeric characters, one or more non-numeric characters, and/or one or more symbols, and the suffix indicator includes one or more alphanumeric characters, one or more non-numeric characters, and/or one or more symbols.

12. The system of claim 9, wherein the system is configured to determine that:

a trackside sign is applicable when the prefix indicator is a first character/symbol, the suffix indicator is a second character/symbol, and the image(s) of the trackside sign exits left of frame thereby meaning the track is to the right of the trackside sign;

a trackside sign is applicable when the prefix indicator is the second character/symbol, the suffix indicator is the first character/symbol, and the image of the trackside sign exits right of frame thereby meaning the track is to the left of the trackside sign; and a trackside sign is applicable when the prefix indicator is the second character/symbol, the suffix indicator is the second character/symbol, and the image of the trackside sign exits left or right of frame thereby meaning there are parallel pullback stopping protection (PSP) tracks.

13. The system of claim 9, wherein the system is configured to determine that:

a trackside sign is applicable when the prefix indicator is 0, the suffix indicator is 1, and the image(s) of the trackside sign exits left of frame thereby meaning the track is to the right of the trackside sign;

a trackside sign is applicable when the prefix indicator is 1, the suffix indicator is 0, and the image of the trackside sign exits right of frame thereby meaning the track is to the left of the trackside sign; and a trackside sign is applicable when the prefix indicator is 1, the suffix indicator is 1, and the image of the trackside sign exits left or right of frame thereby meaning there are parallel pullback stopping protection (PSP) tracks.

14. An automated vision-based system for locomotive location determination, the system comprising:

at least one camera positionable onboard a locomotive for capturing one or more images of trackside signage including location data corresponding with location(s) along a track; and at least one processor configured for communication with the at least one camera for receiving the one or more images of the trackside signage captured by the at least one camera, the at least one processor configured to analyze the one or more images and visually recognize the location data of the trackside signage in the one or more images captured by the at least one camera, thereby enabling the system to identify the locomotive's location along the track via the at least one processor's visual recognition of the location data of the trackside signage;

wherein the trackside signage includes a plurality of trackside signs each including location data in the form of an identification to which has been associated one or more attributes for enforcing a stopping trajectory; and wherein the location data of a trackside sign comprises payload data including an identification, a prefix indicator, and a suffix indicator.

15. The system of claim 14, wherein:

the identification of the payload data on a trackside sign is part of a binary map file in a remote control locomotive (RCL) system for the locomotive; and the RCL system is configured to apply one or more attributes associated with the identification of the payload data on the trackside sign for controlling operation of the locomotive after reading the identification of the payload data on the trackside sign that is part of the binary map file and expected to be a next value.

16. The system of claim 15, wherein:

the RCL system is configured to apply one or more of maximum push speed, maximum pull speed, train brake reduction, and/or an alert, after reading the identification of the payload data on the trackside sign that is part of the binary map file and that indicates the payload data is as expected to be the next value; and/or the RCL system is configured to read strings of the payload data on vision posts, such that if an incorrect string is misread from a vision post:

the incorrect string will not be in the binary map file; or the current locomotive location based on GPS subzone and odometer values will not indicate that the payload data was expected so the incorrect string of the payload data will be disregarded.

17. A method of determining location of a locomotive along a track, the method comprising:

capturing, via at least one camera onboard the locomotive, one or more images of trackside signage including location data that corresponds with location(s) along the track;

visually recognizing, via at least one processor onboard the locomotive, the location data of the trackside signage in the one or more images captured via the at least one camera, to thereby identify the locomotive's location along the track; and controlling the locomotive according to a stopping trajectory including a continually descending speed limit along a pullback track that is implemented through the placement of the trackside signage and an overlay of geofences, such that the locomotive is stopped before a predetermined point on the pullback track.

18. The method of claim 17, wherein the method includes positioning the trackside signage at locations along the track corresponding with the location data of the trackside signage.

19. The method of claim 17, wherein the method includes positioning the trackside signage along the track to define one or more pullback stopping protection (PSP) zones, whereby location data visually recognizable in the one or more images of the trackside signage is usable for pullback stopping protection (PSP) functionality.

20. The method of claim 17, wherein the method includes:

capturing, via at least one video camera onboard the locomotive, video of the trackside signage including the location data of the trackside signage; and visually recognizing, via the at least one processor onboard the locomotive, the location data of the trackside signage in a video feed captured by the at least one video camera.

21. The method of claim 17, wherein the trackside signage includes a plurality of trackside signs each including location data in the form of an identification to which has been associated one or more attributes for enforcing a stopping trajectory.

22. The method of claim 21, wherein:

each said trackside sign includes a same colored border around the identification of the trackside sign; and each said trackside sign includes a numeric identification, an alphanumeric identification, or a non-numeric identification including one or more symbols.

23. The method of claim 17, wherein:

the trackside signage comprises existing track identifying signage positioned along the track; and the method includes:

capturing, via the at least one camera onboard the locomotive, one or more images of the existing track identifying signage positioned along the track; and visually recognizing, via the at least one processor onboard the locomotive, the existing track identifying signage to thereby identify the track corresponding with the existing track identifying signage from a plurality of tracks.

24. The method of claim 17, wherein the method includes:

associating GPS coordinates with a visually recognized trackside sign to thereby determine location of the locomotive; and using an odometer for location tracking of the locomotive along the track until the locomotive arrives at a next trackside sign.

25. A method of determining location of a locomotive along a track, the method comprising:

capturing, via at least one camera onboard the locomotive, one or more images of trackside signage including location data that corresponds with location(s) along the track; and visually recognizing, via at least one processor onboard the locomotive, the location data of the trackside signage in the one or more images captured via the at least one camera, to thereby identify the locomotive's location along the track;

wherein:

the trackside signage includes a plurality of trackside signs each including location data in the form of an identification to which has been associated one or more attributes for enforcing a stopping trajectory;

each said trackside sign further includes a prefix indicator and a suffix indicator; and the method includes determining a left or right direction in which a trackside sign leaves or enters the at least one camera's field of vision and thereafter using the determined left or right direction with the trackside sign's prefix indicator and/or suffix indicator to determine if the trackside sign is applicable to the track that the locomotive is using.

26. The method of claim 25, wherein the method includes controlling the locomotive according to a stopping trajectory including a continually descending speed limit along a pullback track that is implemented through the placement of the trackside signage and an overlay of geofences, such that the locomotive is stopped before a predetermined point on the pullback track.

27. The method of claim 25, wherein the method includes determining that:

a trackside sign is applicable when the prefix indicator is a first character/symbol, the suffix indicator is a second character/symbol, and the image(s) of the trackside sign exits left of frame thereby meaning the track is to the right of the trackside sign;

a trackside sign is applicable when the prefix indicator is the second character/symbol, the suffix indicator is the first character/symbol, and the image of the trackside sign exits right of frame thereby meaning the track is to the left of the trackside sign; and a trackside sign is applicable when the prefix indicator is the second character/symbol, the suffix indicator is the second character/symbol, and the image of the trackside sign exits left or right of frame thereby meaning there are parallel pullback stopping protection (PSP) tracks.

28. The method of claim 25, wherein the method includes determining that:

a trackside sign is applicable when the prefix indicator is 0, the suffix indicator is 1, and the image(s) of the trackside sign exits left of frame thereby meaning the track is to the right of the trackside sign;

a trackside sign is applicable when the prefix indicator is 1, the suffix indicator is 0, and the image of the trackside sign exits right of frame thereby meaning the track is to the left of the trackside sign; and a trackside sign is applicable when the prefix indicator is 1, the suffix indicator is 1, and the image of the trackside sign exits left or right of frame thereby meaning there are parallel pullback stopping protection (PSP) tracks.

29. A method of determining location of a locomotive along a track, the method comprising:

capturing, via at least one camera onboard the locomotive, one or more images of trackside signage including location data that corresponds with location(s) along the track; and visually recognizing, via at least one processor onboard the locomotive, the location data of the trackside signage in the one or more images captured via the at least one camera, to thereby identify the locomotive's location along the track;

wherein:

the location data of a trackside sign comprises payload data including an identification, a prefix indicator, and a suffix indicator;

the identification of the payload data on a trackside sign is part of a binary map file; and the method includes applying one or more attributes associated with the identification of the payload data on the trackside sign for controlling operation of the locomotive after reading the identification of the payload data on the trackside sign that is part of the binary map file and expected to be a next value.

30. The method claim 29, wherein:

the method includes applying one or more of maximum push speed, maximum pull speed, train brake reduction, and/or alert after reading the identification of the payload data on the trackside sign that is part of the binary map file and that indicates the payload data is as expected; and/or the method includes reading strings of the payload data on vision posts and if an incorrect string is misread from a vision post:

determining that the incorrect string is not in the binary map file; or disregarding the incorrect string after determining that the current locomotive location based on GPS subzone and odometer values does not indicate that the payload data was expected.

31. A locomotive controller comprising:

memory configured to store computer-executable instructions; and at least one processor configured for communication with at least one camera positionable onboard a locomotive for receiving one or more images of trackside signage captured by the at least one camera;

wherein the processor is in communication with the memory to execute the computer-executable instructions to visually recognize location data of the trackside signage in the one or more images captured via the at least one camera to thereby identify the locomotive's location along a track; and wherein the locomotive controller is configured to control the locomotive according to a stopping trajectory along a pullback track that is implemented through the placement of the trackside signage and an overlay of geofences, whereby the locomotive controller is configured to enforce a continually descending speed limit to bring the locomotive to a stop before a predetermined point on the pullback track.

* * * * *